United States Patent [19]

Woodworth et al.

[11] 4,074,171

[45] Feb. 14, 1978

[54] ELECTRONIC FLASH DEVICE

[75] Inventors: Frederick Arthur Woodworth, Romiley, England; Ernst-Guenther Zobel, Watten Terrace, Singapore

[73] Assignee: U.S. Philips Corporation, New York, N.Y.

[21] Appl. No.: 492,417

[22] Filed: July 29, 1974

[30] Foreign Application Priority Data

Aug. 23, 1973 Germany ..... 2339094

[51] Int. Cl.[2] ..... H05B 37/00

[52] U.S. Cl. ..... 315/241 P; 315/151; 315/159

[58] Field of Search ..... 315/241 P, 151, 159, 315/241 R, 156, 240; 307/252 H, 252 M

[56] References Cited

U.S. PATENT DOCUMENTS

| | | | |
|---|---|---|---|
| Re. 28,025 | 5/1974 | Murata et al. | 315/241 P |
| 3,332,074 | 7/1967 | Arnold | 307/252 H |
| 3,740,610 | 6/1973 | Roncke | 315/241 P |
| 3,814,985 | 6/1974 | Pecher et al. | 315/241 P |
| 3,849,703 | 11/1974 | Shimamura et al. | 315/241 P |
| 3,953,783 | 4/1976 | Peters, Jr. | 307/252 M X |

OTHER PUBLICATIONS

"Capacitor Turn-Off Circuits" — SCR Manual, Second Edition (General Electric), pp. 73–75, 1961.

*Primary Examiner*—Lawrence J. Dahl
*Attorney, Agent, or Firm*—Frank R. Trifari; Bernard Franzblau

[57] ABSTRACT

The invention relates to an electronic flash device which is provided with a series arrangement of an electronic flash tube and a thyristor, which flash device is equipped with a flash duration limiter (computer electronic flash device).

According to the invention a rectifier is connected anti-parallel to the thyristor. As a result a smaller thyristor can be used, while the energy consumption can be reduced and an unwanted "light spike" at the end of the flash duration can be avoided.

13 Claims, 1 Drawing Figure

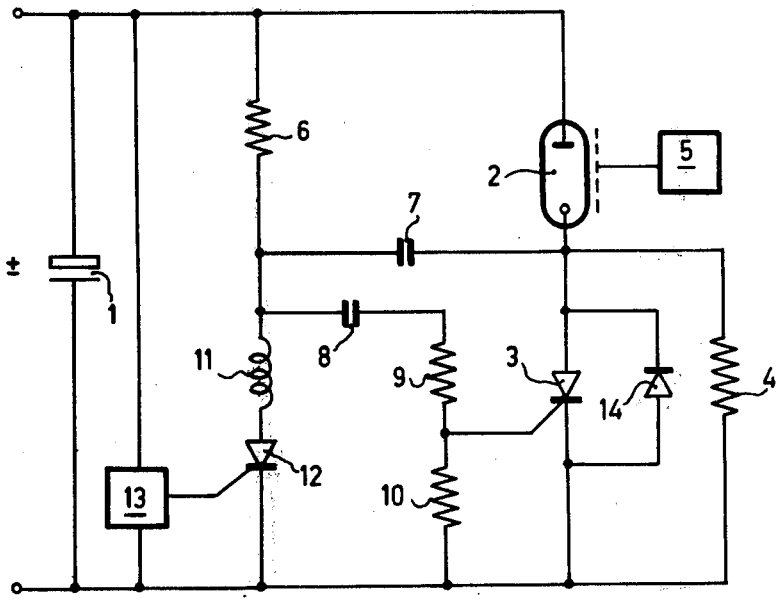
6
2
5
7
±
1
11
8
9
3
14
4
12
13
10

ELECTRONIC FLASH DEVICE

The invention relates to an electronic flash device provided with an electronic flash tube and a first capacitor, in which a series arrangement of at least the flash tube and a thyristor connects the electrodes of the first capacitor together and in which a flash duration limiter is present which includes a series arrangement of at least a second capacitor and a switch, and in which the last mentioned series arrangement shunts the thyristor.

A known electronic flash device of the kind mentioned above is described, for example, U.S. Pat. No. 3,740,610.

In this known electronic flash device and also in other electronic flash devices known from the prior art, the first capacitor (storage capacitor) is charged together with the second capacitor (quenching capacitor) through a converter. The thyristor is rendered conducting in these known electronic flash devices so that the first capacitor is discharged across the flash tube, thus generating a flash of light. Part of the quantity of light emitted by the flash tube is reflected by an object, generally an object to be photographed, onto a photosensitive element of an exposure measuring device. In this measuring device the received quantity of light is integrated, which device applies a control signal to operate the switch when a predetermined integration value is reached. The switch then connects the charged second capacitor to the thyristor in a manner such that the discharge current of this second capacitor flows in the opposite direction through the thyristor. The result is that the current through the thyristor drops below its hold current value and is maintained below that value for a period of time greater than its recovery time so that the thyristor blocks a voltage in its pass direction again. This leads to the definitive extinction of the flush.

The switch may consist of, for example, a quench tube or a further thyristor.

In electronic flash devices of the kind described in the preamble the inventors have found that the main thyristor relatively often becomes defective during the quenching process.

A further drawback of the said known electronic flash devices is that turn-off during the process of the thyristor the light intensity of the flash tube is increased, that is to say a light "spike" occurs just before the end of the flash. This light spike is caused by the fact that substantially the entire current of the second capacitor flows through the flash tube at the end of the quenching process. Since the flash duration limiter always gives a command for quenching the flash tube at the instant when the associated exposure measuring device has received a sufficient quantity of light, the aforesaid light spike leads to overexposure, for example, of a photographic negative. This drawback becomes manifest to a very great extent when taking photographic close-ups because the radiation emitted by said light spike is large in proportion to the radiation required for a correct exposure.

An object of the invention is to obviate or at least mitigate the said drawbacks in an electronic flash device of the kind described in the preamble.

According to the invention an electronic flash device provided with an electronic flash tube and a first capacitor, in which a series arrangement of at least the flash tube and a thyristor connects the electrodes of the first capacitor together and in which a flash duration limiter is present which includes a series arrangement of at least a second capacitor and a switch, and in which the last mentioned series arrangement shunts the thyristor, is characterized in that the thyristor is also shunted by a rectifier whose pass direction is opposite to that of the thyristor. Such a rectifier is hereinafter referred to as an "anti-parallel" rectifier.

An advantage of this device is that during the quenching process the potential difference in the blocking direction across the thyristor is very low so that the heat produced in this thyristor is small and consequently the temperature of this thyristor can no longer increase to such values that its crystal structure is damaged.

A further advantage of a device according to the invention is that the light spike at the end of the flash, and hence the erroneous exposure, is substantially eliminated. This is due to the fact that the current for discharging the second capacitor, and possibly charging this capacitor in the reverse direction, substantially does not flow through the flash tube but mainly passes through the anti-parallel rectifier after the current through the thyristor has terminated.

A further advantage is that energy is saved due to the elimination of the light spike. This becomes manifest in the first capacitor being discharged to a lesser extent during flashing. Consequently more flashes can be produced per battery charge.

In a device according to the invention the development of heat in the thyristor during the quenching process is low due to the low value of the voltage across this thyristor in its blocking direction. Consequently, the electronic flash device according to the invention may be equipped with a thyristor having a relatively small semiconductor crystal surface.

Since the recovery time of a thyristor is dependent on the temperature of the semiconductor crystal during the quenching process, the circuit-imposed turn-off time in a circuit that is not provided with an anti-parallel rectifier, i.e. a circuit not accordance with the invention, should be chosen to be relatively high due to the great temperature increase of the crystal surface during quenching of the thyristor. Such a large circuit-imposed turn-off time generally, however, also implies the use of a second capacitor with a large capacitance.

In a device according to the invention the crystal surface of the thyristor is hardly increased in temperature during the quenching process so that its recovery time, and consequently the circuit-imposed turn-off time, may be relatively short. This implies the possibility of reducing the time between two consecutive flashes. Sometimes this can lead to a smaller capacitance of the second capacitor and hence to a reduction of the volume of the electronic flash device.

It is to be noted that a circuit with a thyristor shunted by an anti-parallel rectifier is known per se, for example, from British Patent 1,062,736. In this Patent, however, electronic flash devices are not referred to. In the patent a device is referred to in which the main circuit of a non-defined load, namely the series arrangement of load and a thyristor, also includes an inductive blocking member. Such a member in the lamp current circuit is, however, undesirable for electronic flash devices because the rate of current increase at the commencement of the flash would be reduced. Further, the aforesaid British Patent 1,062,736, does not refer to a load which is fed by a rapid discharge from a storage capacitor.

British Patent No. 1,179,556 also describes a circuit with a thyristor shunted by an anti-parallel rectifier. In this circuit the main current circuit, as in the last-mentioned case, is inductive because the load itself is inductive and furthermore the energy supply is not provided by a capacitor.

Furthermore it is to be noted that elimination of the light spike in some way or other during the quenching process takes place in a different manner in a known electronic flash device by impressing an electric bias on the main electrode of the thyristor remote from the flash tube. This is effected with the aid of an auxiliary capacitor and the value of the bias is chosen to be such that a fast depletion of the charge carriers of the thyristor takes place. See, for example, FIG. 3 of German "Offenlegungsschrift" 2,040,499. A drawback of this known flash device is, however, that this auxiliary capacitor must initially be charged to a higher voltage than that of the first capacitor. This auxiliary capacitor is therefore provided with a separate charge device. As described in said German Offenlegungsschrift 2,040,499, this separate charge device is not necessary when a choke is incorporated between the cathode of the thyristor and the first capacitor whereby a central tap of this choke is connected to the positive electrode of the auxiliary capacitor. Such a relatively large T-choke enlarges, however, the required volume of the electronic flash device and has a cost-increasing effect.

In a device according to the invention the thyristor cathode can be connected directly to the flash tube in the series arrangement of the flash tube and the thyristor. In other words, the pass direction of the thyristor is in the direction towards the flash tube. See, for example, the circuit shown in United Kingdom Patent Specification No. 1,328,655. The pass direction of the thyristor may, however, alternatively be in the direction away from the flash tube.

Some inductance of the parts of the quenching circuit (second capacitor, switch, thyristor with antiparallel rectifier) can sometimes lead to a slight-charging of the second capacitor in the opposite direction during the quenching process. This increases the circuit-imposed turn-off time of the thyristor.

In a preferred embodiment of an electronic flash tube according to the invention the series arrangement of the second capacitor and the switch also includes a series choke.

An advantage of this preferred embodiment is that a sufficient circuit-imposed turn-off time for the thyristor is better insured because the second capacitor is, during the quenching process, not only discharged but subsequently is also charged for a relatively long time in the opposite direction.

The blocking voltage across the thyristor is preferably 6 volts at a maximum in a device according to the invention. This is realized by the choice of the type of anti-parallel rectifier.

The temperature increase of the thyristors suitable for currents occurring in electronic flash devices is found to be substantially negligible at these low blocking voltage values.

An embodiment of the invention will now be described by way of example with reference to the accompanying drawing which shows an electric circuit of an electronic flash device according to the invention.

In the FIGURE the reference numeral 1 denotes a first capacitor, namely a storage capacitor. This capacitor is first charged by a convertor, not shown, in such a manner that the polarity corresponds to that shown in the FIGURE. The electrodes of the capacitor 1 are connected to a series arrangement of an electronic (gas discharge) flash tube 2 and a thyristor 3. The thyristor 3 is shunted by a resistor 4. An ignition electrode of the flash tube 2 is connected to an ignition device 5 which generates an ignition pulse, for example, upon closing of a contact of a photo camera. A series arrangement of a resistor 6 and a second capacitor 7 is connected in parallel with the tube 2. The capacitor 7 is the quenching capacitor. A further series arrangement of a third capacitor 8 and two resistors 9 and 10 is connected to a connection point between the resistor 6 and the capacitor 7 at one end and the cathode of the thyristor 3 at the other end. The resistor 10 connects the control electrode to the cathode of the thyristor 3. The series arrangement 8, 9, 10 is shunted by a series arrangement of a coil 11 and a switch, namely a quenching thyristor 12. A control electrode of the quenching thyristor 12 is connected to an exposure measuring device 13 not shown in detail, which is provided with a photosensitive element, not shown. This photosensitive element is arranged in a known manner for so-called "computer" electronic flash devices so that it receives part of the light projected by the flash tube 2 onto an object to be photographed and reflected by this object. The device 13 measures and integrates this light and applies a control signal to the control electrode of the thyristor 12 when a given integration value is reached. A diode 14 is arranged in anti-parallel with the thyristor 3, i.e. in such a manner that the pass directions of thyristor 3 and diode 14 are opposite to each other. The diode 14 is of such a type that the voltage in its pass direction upon the passage of current is about 4 to 6 volts so that upon quenching the thyristor 3 a temperature occurs in this thyristor at which the recovery time of this thyristor remains shorter than the circuit-imposed turn-off time which is determined by the quenching circuit comprising capacitor 7, coil 11, quenching thyristor 12, and thyristor 3 with diode 14.

The device described operates as follows: first the storage capacitor 1 is charged to the operating voltage. Simultaneously therewith the quenching capacitor 7 and the capacitor 8 are charged — through the resistor 6 — to the same operating voltage. The full operating voltage is then present between the electrodes of the flash tube 2 while the voltage between the main electrodes of the thyristor 3 is zero.

Upon operation of the ignition device 5, an ignition pulse is generated which ignites the flash tube 2. Upon ignition of the flash tube 2 the potential on the anode of the thyristor 3 increases very quickly. As a result an abrupt voltage variation across the potential divider comprising the resistors 9 and 10 is realized, which leads to a positive pulse on the control electrode of the thyristor 3. This thyristor is thereby rendered conducting so that the flash tube 2 starts to convey a large discharge current of capacitor 1. As a result this tube generates a flash of light.

When the measuring device 13 has detected that sufficient light has impinged on the object to be photographed, a control pulse, as stated hereinbefore, is applied to the control electrode of the quenching thyristor 12 which thereby becomes conducting. The capacitor 7, substantially charged to the operating voltage, is then discharged across the coil 11 and the diode 14. This is effected rapidly due to the low resistance in this quenching circuit. This quenching current ensures that the current initially flowing through the thyristor 3 drops below the hold current value and thereupon blocks the thyristor 3 so that the discharge process of the capacitor 1 is discontinued. In order that the thyristor 3 be fully blocked, a negative voltage (namely a voltage in the blocking direction of the thyristor) must be maintained across the thyristor for a certain period, namely the recovery time. This negative voltage, which may be very low, is determined by the voltage across the diode 14 in its pass direction (during discharge of the quenching capacitor 7). This voltage remains present during the circuit-imposed turn-off time of the quenching circuit, which is longer than the recovery time of the thyristor 3. A decrease in the recovery time of the thyristor 3 is furthermore brought about by the discharge of the capacitor 8 across the resistor 10. Due to the discharge of this capacitor 8 a voltage drop occurs across resistor 10 which accelerates the depletion of charge carriers from the thyristor 3.

Without the diode 14, that is to say in a circuit not according to the invention, the following situation occurred. Upon rendering thyristor 12 conducting, i.e. at the commencement of the quenching process, the capacitor 7 starts to discharge so that the initial current through thyristor 3 is counteracted. If the resultant thyristor current then falls below the hold current value and even becomes negative to a slight extent (i.e. when it flows in the blocking direction) a high voltage (several hundred volts) occurs across the thyristor in the blocking direction. This leads to a power of several kilowatts in the thyristor which is often disastrous for this thyristor. In addition an electric current flows through tube 2 to the capacitor 7, coil 11 and the thyristor 12 to the capacitor 1. This leads to a large unwanted light spike in tube 2 and to a useless further discharge of the capacitor 1.

If, according to the invention, the diode 14 is present, the temperature of the thyristor 3 remains at a safe value and the current through capacitor 7 substantially flows through the diode 14 so that no light spike is generated.

Optimum operation of the diode is obtained when the inductance in the leads from the diode to the thyristor terminals is as low as possible. These leads should therefore be chosen to be as short as possible. Preferably, the thyristor and diode are formed monolithically. It is alternatively feasible for the thyristor and the diode to be formed as two separate semiconductor crystals electrically connected together within a common housing. Such a semiconductor device is sometimes referred to as a "twin-chip."

What is claimed is:

1. An electronic flash device comprising, a pair of voltage supply terminals, an electronic flash tube, a first capacitor connected across said supply terminals, a thyristor, means connecting the series arrangement of the flash tube and the thyristor across the electrodes of the first capacitor, means including said thyristor for initiating a flash of light in said flash tube, a flash duration limiter comprising a series arrangement of a second capacitor and an electronic switch connected in shunt with the thyristor, said flash duration limiter normally producing a light spike in the flash tube upon operation of the electronic switch, and means for inhibiting said light spike comprising a rectifier connected in shunt with the thyristor with its pass direction opposite to that of the thyristor.

2. An electronic flash device as claimed in claim 1, wherein the series arrangement of the second capacitor and the switch also includes a series inductor.

3. An electronic flash device as claimed in claim 1 wherein the properties of the rectifier are chosen so that the flow of a current in its pass direction produces a maximum voltage across said rectifier of approximately 6 volts.

4. An electronic flash unit comprising, a pair of voltage supply terminals, a first capacitor connected across said pair of supply terminals, a flash discharge tube, a controlled rectifier, means connecting the flash tube and the controlled rectifier in series across the terminals of the first capacitor, means for applying an aperiodic trigger voltage to a control electrode of the controlled rectifier, a turn-off control circuit for said controlled rectifier comprising the series connection of a switching element and a second capacitor connected in parallel with the controlled rectifier, a charge circuit coupling the second capacitor to the input terminals, said second capacitor normally producing a surge of discharge current flowing through the flash tube to produce a light spike upon operation of the switching element, means for reducing said light spike by providing an alternate discharge path for the second capacitor exclusive of the flash tube and comprising a rectifier connected in antiparallel with the controlled rectifier so as to limit the reverse voltage appearing across the controlled rectifier during the turn-off period of the controlled rectifier, and means for operating the switching element to initiate said turn-off period.

5. A flash unit as claimed in claim 4 further comprising an inductor connected in series with the switching element and the second capacitor directly across the main terminals of the controlled rectifier.

6. A flash unit as claimed in claim 4 wherein said trigger voltage applying means comprises a third capacitor coupling the common junction between the flash tube and the controlled rectifier to the control electrode of said controlled rectifier thereby to apply a trigger voltage to said control electrode in response to the firing of said flash tube.

7. A flash unit as claimed in claim 4 wherein said charge circuit includes a first impedance element connected in series with the second capacitor across the terminals of the flash tube and said turn-off control circuit is connected directly across the main electrodes of the controlled rectifier.

8. A flash unit as claimed in claim 7 further comprising a series circuit including a third capacitor and first and second resistors, and means connecting said series circuit between the junction point formed between the first impedance element and the second capacitor and one main electrode of the controlled rectifier, and means connecting a tap point on said series circuit to the control electrode of the controlled rectifier thereby to apply a trigger voltage to said control electrode in response to the firing of said flash tube.

9. A flash unit as claimed in claim 4 wherein said flash tube has a unidirectional current flow characteristic and the switch operating means comprises control means responsive to the light reflected from a flashed object for applying a second trigger voltage to a control electrode of the switching element to initiate a turn-off period.

10. A flash unit as claimed in claim 4 further comprising a third capacitor and a first impedance element connected in series across the switching element, a charge circuit for the third capacitor that is independent of the flash tube, and means for coupling said first impedance element across the cathode and control electrode of the controlled rectifier whereby operation of the switching element causes the third capacitor to discharge via the switching element to produce across said first impedance element a reverse polarity voltage for accelerating the turn-off of the controlled rectifier.

11. A flash unit as claimed in claim 4 wherein said trigger voltage applying means comprises a third capacitor connected in series with the second capacitor between the control electrode of the controlled rectifier and the junction point formed between the flash tube and the controlled rectifier.

12. A flash unit as claimed in claim 11 further comprising a first impedance element connected between the control electrode of the controlled rectifier and one terminal of the switching element whereby operation of the switching element provides a discharge path for the third capacitor that includes the switching element and the first impedance element thereby to produce across said first impedance element a reverse polarity voltage which accelerates the turn-off of the controlled rectifier.

13. A flash unit as claimed in claim 4 wherein said turn-off control circuit is connected at one end to the junction between said flash tube and one main electrode of the controlled rectifier and is connected at its other end to the other main electrode of the controlled rectifier whereby operation of the switching element allows a discharge current to flow from said second capacitor through the switching element in a manner such that substantially none of the discharge current passing through the switching element flows into the first capacitor or into the flash tube.

* * * * *

UNITED STATES PATENT OFFICE

CERTIFICATE OF CORRECTION

Patent No. 4,074,171 Dated February 14, 1978

Inventor(s) FREDERICK ARTHUR WOODWORTH ET AL

It is certified that error appears in the above-identified patent and that said Letters Patent are hereby corrected as shown below:

IN THE TITLE PAGE

Sec. [30] "Aug. 23, 1973 Germany.....2339094"

should read

--Aug. 2, 1973 West Germany.....2339094
Aug. 2, 1973 West Germany.....2339119--

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*